United States Patent [19]

Christensson

[11] 4,018,030

[45] Apr. 19, 1977

[54] ARRANGEMENT FOR VACUUM PACKING OF FOODSTUFFS AND THE LIKE

[75] Inventor: Od Wikar Christensson, Stockholm-Bromma, Sweden

[73] Assignee: Christenssons Maskiner & Patenter AB, Stockholm-Bromma, Sweden

[22] Filed: May 6, 1975

[21] Appl. No.: 575,076

Related U.S. Application Data

[62] Division of Ser. No. 340,197, March 12, 1973.

[52] U.S. Cl. ..... 53/124 B; 100/90; 141/80

[51] Int. Cl.[2] ..... B65B 1/24

[58] Field of Search ..... 53/124 B; 141/80; 100/90

[56] References Cited

UNITED STATES PATENTS

| | | | |
|---|---|---|---|
| 291,683 | 1/1884 | Chapman | 53/124 B X |
| 2,132,618 | 10/1938 | Hill | 100/240 X |
| 3,748,819 | 7/1973 | Christensson | 53/124 B |

FOREIGN PATENTS OR APPLICATIONS

| | | | |
|---|---|---|---|
| 1,201,793 | 6/1959 | France | 53/124 B |

*Primary Examiner*—Travis S. McGehee
*Attorney, Agent, or Firm*—Larson, Taylor and Hinds

[57] ABSTRACT

An arrangement for compressing a product to be packed in a package before evacuation of the package which comprises a transport device for carrying a package into which a product has been introduced but which package has not yet been closed, into the range of activity of a piston, means for lowering the piston into the package to act on the free upper surface of the product so as to compress the material in the interior of the package uni-directionally, means for subjecting the package after said compression to evacuation to further reduce the internal pressure of the product to be packed and means for sealing and closing said package. The means for compressing the material in the interior of the package is designed to effect compression to such an extent that the product to be packed will assume at least approximately the volume which the product would assume in the package if no mechanical compression had existed but the only compression had been the one subjected to the package after closing in an evacuation chamber and thereafter being brought out into the ambient atmosphere.

7 Claims, 4 Drawing Figures

ARRANGEMENT FOR VACUUM PACKING OF FOODSTUFFS AND THE LIKE

Figure 1:
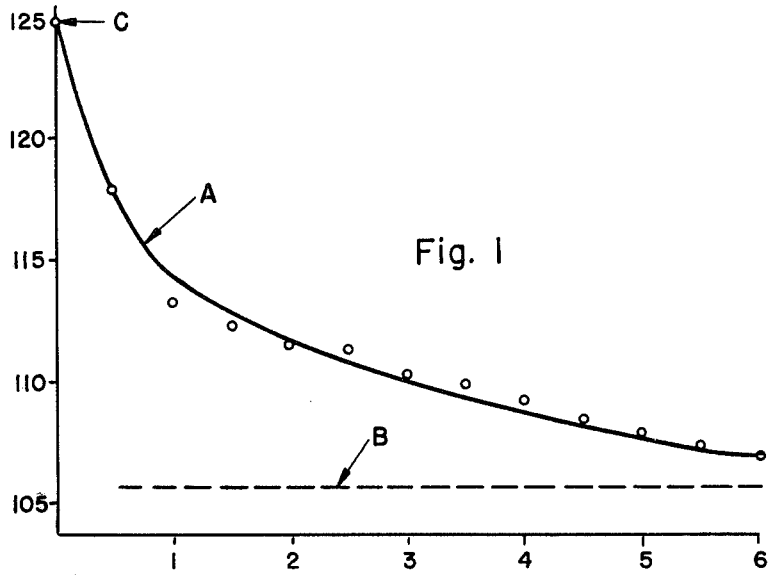

This is a division, of application Ser. No. 340,197 filed Mar. 12, 1973.

In the later time one has to a great extent turned over to packing certain food stuffs in vacuum, especially such ones, containing materials, which are sensitive for the contact with the atmosphere in such a way that they will be subjected to a change dependent upon their contact with said atmosphere. Even if this will apply in first place to food stuffs, there are nevertheless also many other materials, for instance for industrial use, which one wants in a corresponding way to protect against the contact with the atmosphere, for instance some high sensitive oils, certain grinding means in finely divided form and so on. As a typical example for a food stuff, which may be packed under vacuum, coffee should be mentioned, especially roasted, finely ground coffee. Coffee contains rather a lot of aromatic oils which are easily oxidized under the influence of the oxygen of the atmosphere, which is called within the food stuff industry that the coffee has got "rancid". This word is derived from the part of the food stuff industry, dealing with fats such as butter and margarine. Also these fats may get "rancid".

By such a change when storing in the atmosphere, the product concerned will firstly lose part of its aroma, because the aroma is to an essential extent represented just by the said aromatic oil, and partly the product will get an unagreable taste and in some cases even a weakly poisonous action which may utter itself in stomac inconveniences, headache, and indisposition of short duration.

The evacuation in vacuum packaging should therefore take place to a degree, corresponding to only a very small fraction of the pressure of one atmosphere remaining air. This pressure is determined by the solution pressure of the oxygen in the aromatic constituents concerned. Regarding the aromatic oils, existing in coffee, this solution pressure is generally estimated to be in the order of magnitude of 4 to 6 millibar (6 mb). No reaction at all or only a disregardably small reaction, as a matter of fact can take place between the oxygen and the oxydizable constituents concerned, if the partial pressure of the oxygen is lower than the said solution pressure.

Regarding the desire about a rich security margin one has mentioned a value on the remaining air pressure after evacuation of 4 mb which would give a partial pressure for the oxygen of 0,8 mb, but also a less complete evacuation has, in many a case, proved to be satisfactory. The difference in air pressure between the pressure of the atmosphere and the pressure in the interior of the package, anyhow, was close to one atmosphere.

For retaining this degree of evacuation one has used either one of two different methods, viz. firstly to pack the material in extremely tight packages, so called vacuum tight packages, rather often of high class plastic, or plastic lined cardboard, in which the low air pressure could remain during a very long period of time, and sometime also packing the material in packages which after the evacuation were filled with an inactive gas, usually carbon dioxide ($CO_2$) or nitrogen ($N_2$) to such a pressure, that this was weakly higher than the pressure of the atmosphere, so called gas tight packages, whereby one prevented that the atmosphere also at micro-untightnesses, could enter into the package, which in the last mentioned case, usually was made in the form of tins of sheet metal.

These two methods of packaging are rather expensive. The expenses divide themselves upon amortizing and use of the packaging machine, on the one hand, and material costs such as cardboard, plastic, sheet metal and gas, on the other hand. The first mentioned costs, as a rule, are mainly independent of the magnitude of the package, whereas the last mentioned costs are practically proportional to the magnitude of the package.

The present invention is based upon an investigation, to what an extent the last mentioned costs could be decreased by decreasing the magnitude of the size of the package, but retaining the quantity of the product packed therein unchanged.

As an example for the decrease of the volume of the package, which one could achieve in the best possible case, the following may be mentioned:

When packaging ground coffee in plastic lined cardboard packages, these are filled with the ground coffee, and they are thereafter subjected to a moderate shaking, whereafter they are closed at the mouth formed by the plastic liner except for a small opening, through which the evacuation shall take place. Thereafter they are brought into a vacuum chamber, in which the evacuation takes place, and when they are till under vacuum, the means when the air pressure outside of the package and in the interior of the package are still the same ones, although much lower than the pressure of the outer atmosphere, they are completely closed, by the evacuation opening also being welded together. When the package is thereafter brought out from the vacuum chamber, its outside is subjected to practically a full atmosphere pressure, which causes a sudden, strong compression of the coffee, whereby the plastic liner gets free from the inner side of the outer package of cardboard, and the interior package formed by the plastic liner is decreasing in volume. By the shaking, the volume has already decreased by between 2 and 3%, and after the evacuation the volume will further decrease in the order of magnitude of between 15 and 20% in relation to the volume immediately after the shaking procedure but before the evacuation. The exact value of this decrease of volume cannot be indicated, because it is dependent upon a lot of different circumstances outside of the control of the packager, amongst which should be mentioned the composition of the coffee mix, the degree of roasting the coffee, the degree of finely grinding the coffee, and the interior structure of the separate coffee beans, which varies strongly with different harvests.

In its compressed state, however the packed produce, which has been rather loosely packed, will be compacted, it will get "hard", and the package is in the last mentioned respect rather similar to a piece of some soft wood, for instance balsa.

In the said kinds of vacuum packing, it has thus been usual that one shaked the product after it has been filled into the package, in order that the package should decrease in volume, however this shaking took place before the evacuation. Such a shaking, however, if it takes place during a rather short period of time will only cause a rather unessential decrease of the volume of the product, usually in the order of magnitude of 2 or 3% of the initial volume of the packed product. It has, however, also been proposed to subject the product for a long duration shaking, but this has had no success.

Firstly, any shaking, by which the product is brought to decrease in volume rather essentially, for instance in the order of magnitude of 10 – 15%, will take such a long time in the order of magnitude of several minutes, that it cannot be used in industrial packing. It should be mentioned thereby, that in vacuum packing one has now got to speeds of packing up to 180 packages a minute.

Secondly, the product is rather destroyed, so that it will in many a case be impossible to use. This especially applies to all products, which haven been brought to granulated form by grinding. As an example may be mentioned such plant products as coffee. Microscopic investigations have proved, that coffee and many of the products, which are used in granulated form, caused by grinding have a structure, comprising a rather compact core, surrounded by a corona of fine, fibrous threads, usually of such a small order of magnitude, that they cannot be observed by the naked eye. In the mechanical working, created at a long duration shaking, these threads are broken off, and the granules change their character.

The microscopic investigations on coffee, which has been finely ground for brewing, for instance have given the result, that the diameter of the outer circumference of each granule inclusive of the said threads is between 50 and 150% greater than the diameter of the outer circumference of the core. The threads thus are broken away from the core by too intensive shaking, and thereby they form an utterly fine meal, which will pass through any usual filter. These threads cause, regarding finely ground coffee, that the brewed coffee will be muddy and get a bad taste, because certain bitter constituents in the coffee are concentrated to the thread like fibres.

In practice, one therefore had to limit the shaking made to a rather unessential extent, and as a normal procedure of shaking it may be mentioned, that one causes the package with its contents to fall by no more than 2 cm in free fall, repeated between three and six times.

By such a shaking, one will achieve a decrease of volume of maximum between 2 and 3% of the volume of the packed product.

Another circumstance, observed in connection with shaking of granulated material is, that there is no interior bond between the granules, but the only thing taking place is that a more advantageous arrangement of the granules mutually will take place, initially at weak shaking according to the above retaining the threads on the cores, but if the shaking is too intensive, under breaking down of said threads, with the consequence of a stronger decrease of volume. Simultaneously one could observe, that the threads were collected in the form of a fine meal of lighter color, rather a greyish colour, on the upper surface of the material in the form of wells, extending themselves some centimeters down into the material, the material situated around said wells as well as below the bottom of said wells, which had now lost their threads, being arranged in a more space sparing way. Also at an unessential contact with an outer object, however the interior state of the packed product is disarranged, and no bond will be created between the separate graules.

This invention is based upon the observation, that breaking down the threads must not necessarily take place, if one subjects the packed, granulated product instead for a soft mechanical compression. Microscopic investigations have proved, that in this case the threads are not broken free but remain in connection with the granule cores, and that the compression is created by the threads of granules adjacent to each other, are meshing into each other, and so to say hook themselves to each other. Therefore, by mechanical compression one can provide a rather strong bond between the granules, simultaneously as one may compress the mass of granules rather essentially, and in this compressed state the packed product will remain compressed by an inner bond, provided by meshing between the threads, which will not be dissolved, but will instead remain untouched, as long as the mass of compressed granules is not subjected to any outer influence.

The consequence of this will be, that the evacuated product will, after air has been admitted, for instance by opening a small hole in the package, mainly retain its compressed form, but now it will get "soft", which means, that one only has to catch the package between the fingers in order that the compression shall be released and the packed material shall again get mellow and approximately reassume its earlier volume after the shaking but before the compression.

The present invention now is based on the idea, that a compression with outer, mechanical means should be provided of the packed product, perhaps after preceding shaking, but in any case before any evacuation has taken place, whereby it would be possible completely or approximately completely to avoid the decrease of volume, which would otherwise occur when the package is subjected to the pressure of the outer atmosphere, if the packaging material is soft, as is the case with plastic, whereas, in a package of hard material, such as for instance a tin of sheet metal, the packed material will also after the evacuation better fill out the available space. In both cases one will in first place gain the advantage of less wasted packing material.

In preparatory calcules it could be stated, that the gain in material costs for a package, containing a net weight of half a kilogram of coffee, packed in cardboard with plastic liner, will be in the order of magnitude of ¼ – ½ U.S. cent for each package or with other words ½ – 1 U.S. cent per kilogram of packed coffee. Taking regard to the matter of fact, that in a strongly coffee consuming but not coffee producing country, the consumption of packed coffee is in the order of magnitude of 10 kilograms per person and year, it is easily found, that a very essential total spare could be gained.

Comparable relations also exist when packing coffee in tins of sheet metal, and also when packing other products under vacuum, independently of if this takes place in plastic lined cardboard package or in tins of sheet metal. By the compressed product causing a counter pressure against the deformation of the material of the tin, one can with retained rigidity decrease the thickness of the tin material, and to this adds, that the consumption of sheet metal surface will also be smaller.

However, the advantages are not limited to a decrease of the packaging costs, but a lot of other advantages may also be observed. Amongst these the following ones may be mentioned:

The evacuation is more easily effected, because to the same extent as the volume of the package gets smaller, the volume of the vacuum chamber may also be made smaller. The evacuation can take place more quickly, in part due to the decreased volume of the vacuum chamber, in part also due to the quantity of air included in the package after the pre-compression being smaller. By this working speed and working capacity of the packaging machine will be increased.

The risk for air leaking in will be less. If air should leak into the evacuated package, this must swell, but if it has been pre-compressed before the evacuation, it has already its normal volume, and the swelling is counter-acted by the rigidity of the outer package, which, in turn prevents leakage of air.

The volume to be transported will be less. Especially regarding sheet metal packages it should be observed, that one may make the in a pileable form, for instance the same way as cardboard packages were earlier made, with a rectangular cross-section in all directions, whereas one could hitherto for rigidity technical reasons, only make a package made of sheet metal, and evacuated, and filled by gas, as a cylindrical package.

The packed product will fill out the package better and will not shake inside of the outer package.

Tests which have been made, and for which account will be given below, have proved, that one should try to drive the pre-compression about to the volume, which the product in the package should have obtained, if no pre-compression has taken place but instead a traditional evacuation had taken place. One would expect, that a somewhat stronger pressure would be required for this purpose than the pressure of the outer atmosphere, because the pressure of the outer atmosphere on the none pre-compressed package will act all around the package, and therefore it will have a less penetration way to the centre of the packed product, but, on the other side, in pre-compression this will for practical reasons be made by a uni-directional piston pressure, which, consequently, will get a longer penetration way before all of the quantity of the packed product has been subjected to the required pressure.

However, said tests have proved, that this must not necessarily be the case, because the product will normally get its practically full degree of compression already at a pressure, which is somewhat lower than one atmosphere, and which will usually be at about 0.5 to 0.75 atmospheres. The stronger sub-pressure, which has hitherto been used in practice, has not at all intended to cause the compression but its intention was exclusively to decrease the partial pressure of the oxygen to a value below the solution pressure in the sensitive products, for instance the aromatic oils existing in coffee. Thus one could regarding finely ground coffee find, that the pressure on the piston should normally be at least in the order of magnitude between 0.5 and 0.75 $kg/cm^2$, about corresponding to one half or three quarters of an atmosphere, but this value is in no way critical, because in the way, given account for above, different coffee mixes, different coffee grindings, different coffee roastings and different coffee harvests will differ rather essentially in the said respects. The variations thus are great, dependent upon such above mentioned circumstances as the kind of the harvest, the degree of roasting, the composition of the mixture and the degree of grinding. Nevertheless it is advantageous to make the pre-compression at somewhat higher pressure than the one just mentioned, for instance at 1.2 – 1.4 atmosheres, so that a somewhat stronger compression is obtained than corresponding to a pressure of one atmosphere. Examples for this will be given below.

Completely in accordance with the experiences, gained from packages, which have only been compressed by direct influence from the pressure of the outer atmosphere after evacuation and closing, one has also found, that in careful treatment the package practically completely retains the decreased volume assumed at the pre-compression, during a period of time, which is required for carrying them over from the place of the pre-compression to the place of evacuation, or perhaps filling of the gas and finally closing. A given return, below referred to as "re-resilience" of the volume, of course, will take place when the compression pressure is released, but this is rather small, and can be disregarded in practice. Also the magnitude of this re-resilience will be further given account for below with the figure values, collected from practical tests.

It has proved suitable, before the pre-compression proper to execute the package with its contents for a shaking or a vibration, similarly to what was usual in vacuum packing without pre-compression such shaking or vibration, thus, earlier was made when packing powder formed or grain formed material, especially at their vacuum packaging, but it only causes a decrease of the volume of the material to a given limit, in no way corresponding to the one, created when the package is subjected to the pressure of the outer atmosphere after evacuation. When it was mentioned above, that a decrease of volume could take place in the order of magnitude between 15% and 25%, these figures referred to the upper surface sinking, which found place from the value obtained after the shaking or the vibration until the value, obtained after evacuation. In a test with normal shaking (six shakes in free fall from about two centimeters altitude in tight sequence after each other with about one second intermediate time) a sinking without elastic re-resilience of 3% was obtained. The above mentioned decrease of volume therefore is counted from the volume, which had already been decreased in this way.

During the pre-compression procedure proper, of course, the package is momentarily subjected to a not disregardably small super-pressure. Therefore on should protect the package against expansion by spanning it in into a device, which during the procedure of compression creates an inwardly directed counter pressure on the exposed parts, but this device may thereafter be removed, or the package may be removed from said device, as soon as the pre-compression is completed. This, of course, in first place applies to the bottom and the side walls of packages of plastic lined cardboard but also to the bottom of packages of sheet metal, which are round.

In packages of plastic lined cardboard, suitably the last mentioned arrangement should comprise a casing or the like, supporting the sides of the package from outside, whereas a piston should be pushed into the package for compressing its contents. These contents, however, will in their loose state have a volume, superseding the final volume of the package, and therefore one should also arrange a tube like or funnel like device above the package for receiving the surplus of the volume of the packed product before the shaking and/or the pre-compression. In packages of plastic lined cardboard this arrangement may form the upper most part of the plastic liner, but this must then be supported from outside, so that it is not burst, and it must also be kept stretched from the inside, so that the piston will get an opportunity to enter into the mouth of the plastic liner. In sheet metal packages it is suitable to push in a tube formed part in the mouth of the package, which is well adapted to the shape of the mouth, and the compression piston may then move inside of this tube formed part.

Finally, it should be mentioned, that in tests with quickly applied pre-compression by means of a piston fit has been found, that an essential simmering existed along the edge of the piston due to air, flowing away, and that this will in many cases to a non-allowable degree carry with it particles of the material to be packed. For preventing this one may use either one or all of the following methods:

1. Valves are arranged in the piston, said valves being opened for letting out air when the piston is pressed against the product to be packed.

2. The piston pressure is applied in a step wise increased degree and in adapted small steps with pauses of rest inbetween.

3. A preparatory pre-compression is made with a smaller piston, giving a great and broad slot around its outer edge, and is thereafter completed at a second time with a piston mainly completely covering the cross-section of the package.

The invention will be further described below in connection with one form of execution, which is shown in the attached drawings, but it is understood, that the invention shall not be limited to this specific form of execution, but that all different kinds of modifications may occur within the frame of the invention.

In the drawings.

Figure 2:
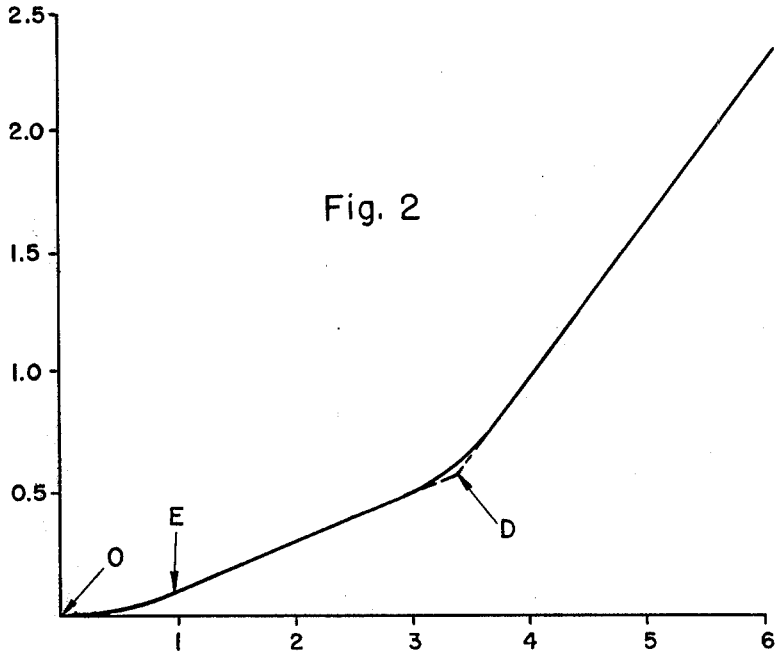
Figure 3:
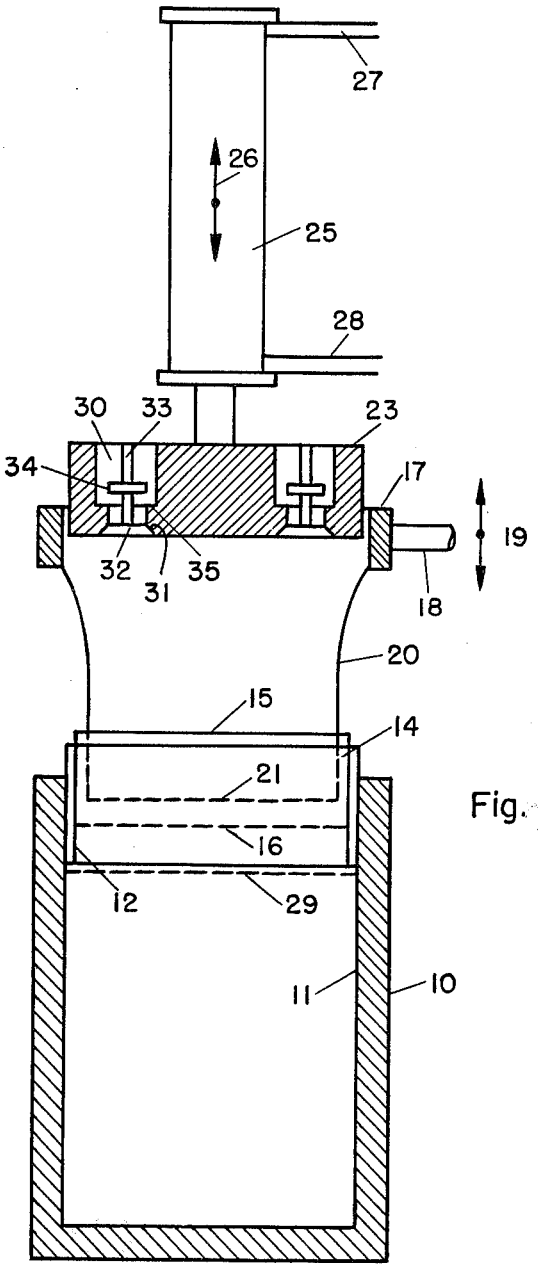
Figure 4:
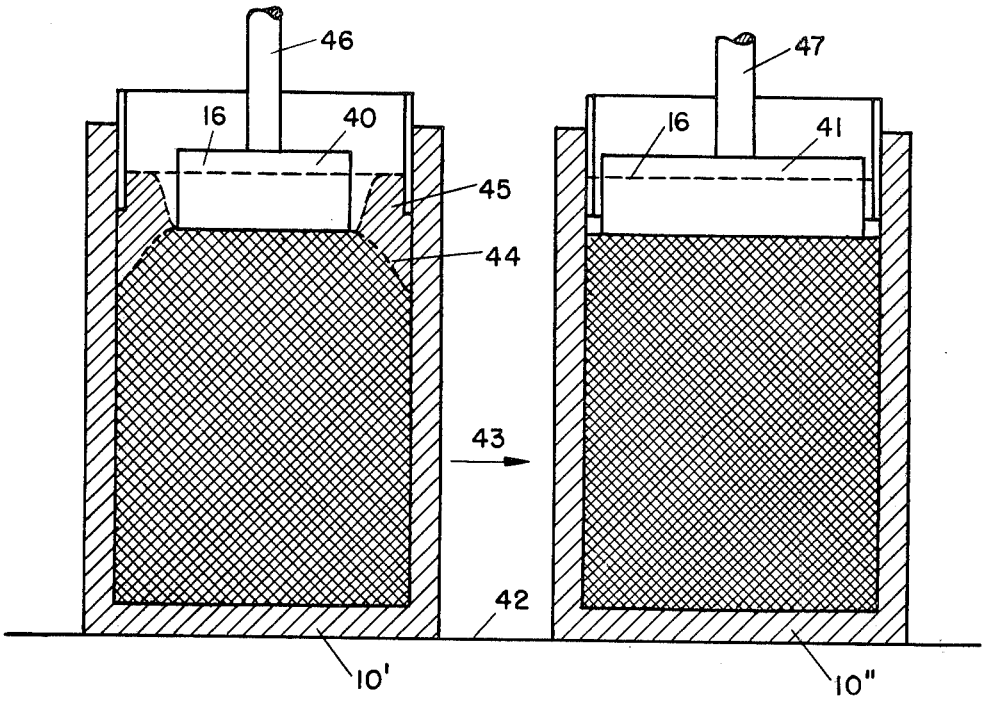

FIGS. 1 and 2 show diagrams for explaining the action of the invention, whereas FIGS. 3 and 4 show a couple of simple forms of execution of the invention in connection with packing ground coffee, in which the package comprises plastic lined cardboard. It should be observed, that the invention may with the same advantage be used in connection with other types of packages of hard material, such as for instance a sheet metal tin.

FIG. 1 shows a diagram over tests with compression of finely ground coffee, whereby along the vertical axis the height position is indicated of the upper coffee level in millimeters and along the horisontal axis the maximum pressure used is indicated in kg/cm$^2$.

For estimation of the reliability of the test, further in FIG. 1 the existing test values have been marked in one of the many tests, made under completely similar conditions. The indicated test values refer to one test, to an especially high degree diaviating from the indicated mean curve for all of the tests.

In the tests, given account for in FIG. 1, one proceeded in the following way:

The package had an inner dimension of 125 mm height and 58 × 108 mm cross-section. First the package was shaked in the traditional way, and thereafter one pre-compressed it with a centrally applied piston having a cross-section of 37 × 69 mm until a pressure, which was indicated for each separate measuring point in the diagram, thereafter the piston was elevated, and one compressed the contents of the package with a piston, which completely filled out the cross-section of the package, whereby the last mentioned piston was loaded to the same total pressure as the first mentioned piston. The indicated pressure along the horisontal axis in FIG. 1 refers to the pressure of the last mentioned piston in kg/cm$^2$ of the cross-section area. Thereafter the last mentioned piston was elevated, and one measured how much the coffee upper level had sunk and also the re-resilience. The coffee was thereafted emptied and mixed with fresh coffee directly from the mill, whereafter the test was repeated exactly the same way, however with a higher pressure, until a complete test series had been gained. A very great number of such test series were made, and the curve shown in FIG. 1 forms a mean curve of them, whereas the measuring points shown in FIG. 1 refer to the specific tests series, which showed the greatest deviations from the mean curve.

The re-resilience in millimeters is indicated in FIG. 2 along the vertical axis, whereas the horisontal axis shows in the same way as in FIG. 1 the applied pressure in kg/cm$^2$.

The curves show some very interesting properties. Thus, one will see, that in FIG. the curve has a point for the smallest curvature radius at the place A and seems assymptotically to approach a line B. The distance between the top point (after shaking but before compression) at C, and the distance to the point A, where the first derivative would have got its inflection point, is in all essential equal to the distance from the point A to the assumptotic line B. The curious behaviour proved to exist in all of the different test, of course not completely exactly, but with a rather good approximation. From this the conclusion may be drawn that the essential pre-compression takes place between the points C and A, whereas thereafter without any appreciable compression an improved arrangement and placing will take place between the grains mutually. Compression to the value A therefore, shall in the sense of the present invention be regarded to mean a compression to at least approximately the volume, to which the package would have been compressed, if no pre-compression had taken place, but if the package had, in the way usual hitherto, been evacuated after shaking and thereafter been subjected to the pressure of the outer atmosphere.

The curve according to FIG. 2, in a rather curious way is composed by two straight lines. Also this, however, may find its explanation. From the origo O until the point D, obviously the compression practically exclusively caused removal of the air existing between the coffee grains, and from this also follows, that the re-resilience should be rather small. It may, as a matter of fact, only be caused by air, which is included between the grains of coffee under an over-pressure. From the point D, however, a real change of size of the grains of coffee must have entered, by which an essential greater elastic re-resilience force is created. One may further assume, that the non-linear re-resilience from the point O until the point E corresponds to a sinking, which could have been achieved only by shaking, if this had been fulfilled longer than was possible for practical reasons.

It should be mentioned, that one also extended these tests far above the pressures shown in the diagrams. However, it proved that the re-resilience thereby increased so strongly, that at 18 kg/cm$^2$ one did not get a higher compression than at 6 kg/cm$^2$, because certainly at application properly of the pressure an essential sinking took place, but this was immediately removed after the pressure caused, so that one got a total sinking, which one could have achieved already by means of 6 kg/cm$^2$. The tests were not carried on so far, that one took the risk of dry welding being created between the grains.

The same tests were also made with a sheet metal tin having a height of 143 mm and a diameter of 157 mm. With regard to the rather great diameter, however, one could in this case directly make the compression with one single piston, which had a diameter, adapted to the interior diameter of the tin. The valves obtained showed mainly full agreement with the values for which account has been given above.

In the arrangement according to FIG. 3 there is a casing 10, in which the plastic lined cardboard package 11 is introduced with its closing flaps 12, 13 and 14 and also with its liner 15 extending above the edge of the casing 10. It is assumed, that the package has been filled with the product to be packed, and which initially was in a height level essentially above the level 16, but which was by shaking or by vibration, brought to sink to this level. In said state the package is brought from the side under a device, in which pre-compression is executed this device comprises two parts. The first active one of these parts is formed by a frame 17, carried up by a holder 18, by means of which the frame 17 may be displaced upwardly or downwardly in the direction of the arrows 19. The frame 17 carries some kind of a resilient means, for instance a rubber skirt of extendible material 20, which, when the frame 17 is lowered onto the package 11, will enter into the mouth of said package, for instance with its lower edge at 21 somewhat above the level 16 of the product to be packed, anyhow, however, to a level lower than the upper edge 22 of the casing 10. The second part, active thereafter, comprising a piston 23, which may be displaced by a piston bar 24 and a pneumatic servo motor 25 in the direction of the arrows 26. The servo motor 25 in the conventional way is provided with a feed tube 27 and a release tube 28 for the pneumatically acting gas, each of them connected to a valve which is, however, not shown, in the drawing. When gas is fed through the conduit 21, the piston is lowered down through the opening in the frame 17 and will press out the extendible protection skirt 20. Thereafter, the piston reaches the upper level 16 of the product to be packed and compresses this to the desired degree, so that the level will sink down for instance to the position 29. In the form of execution shown in the drawing this means a compression to substantially the same degree, which should have been obtained as to the volume, if the package had, without pre-compression, been executed to evacuation after shaking, thereafter to the pressure of the outer atmosphere.

In the piston 23, a number of valve walls 30 are provided, each containing a back movement valve with a valve seat 31 and a valve body 32. The valve shaft 33 is provided with a flange 34, and between a recess 35 and this flange 34 a valve spring not shown in the drawing is introduced. The valves act tightingly during the downward movement of the piston, so that the packed product will not at all or anyway to an extent as small as possible leak out. During the upward movement of the piston 23 following thereafter, however, the valves are opened for letting in air, so that the packed product shall not unnecessarily be moved out of its compressed state.

After the piston 23 has been elevated in this way, also the frame with the rubber skirt 20 is elevated, so that its lower edge 21 will be placed in a position above the upper edge of the liner 15, and the package is moved away for further treatment, viz. in an evacuation apparatus. It is thereby released from the casing and subjected in a way, known per se to such operations, which may precede the evacuation, viz. casing of the upper mouth of the lining, welding this mouth together along the major part of its length, leaving a small unwelded opening for the evacuation. This small part is finally welded together, after evacuation has taken place in the evacuation apparatus.

In FIG. 4 an arrangement is shown, which principally may be of the same type as the arrangement according to FIG. 3, but which is doubled in such a way, that a first compression will take place by means of a piston 40 of an essentially smaller cross section and the cross section of the package, thereafter this piston is elevated, and the package along with its casing is displaced from the position 10' rightward in the drawing to the position 10'' along a path 42, that means in the direction of the arrow 43, and thereafter a second piston 41 is lowered into the package. This is rather exactly dimensioned according to the cross section of the package.

The result will be, that a compression of the product in the package is obtained under the piston 40 in a first procedure, limited by a line 44, so that a ring of non-compressed coffee will remain at 45, and this ring will thereafter be compressed by means of the piston 41 at a second time. For clarifying the difference between a non-compressed, powder formed product, and compressed, powder formed product, the first one has been lined up only one time, whereas the latter one has been cross-lined.

This arrangement mainly corresponds to the one, in which the tests were made, for which account has been given above. The advantage of the last mentioned arrangement in first place is, that a rather broad edge part will exist between the outer edge of the piston 40 and the inner side of the package, which will give a great surface for giving away air. The speed of the air will therefore not be so great, that there is any danger for parts of the packed material to be moved away with the removed air, if the increase of pressure on the piston bars 46 and 47 takes place in steps and in adapted time, as described above.

It should be observed, that due to the compression only very little air will remain between the separate particles of the product to be packed. The major part of the initially existing air has moved away during the procedure of compression, between the edge of the piston 23 or 40, on the one side, and the rubber skirt 20 of the package, on the other side, said parts serving as a lip valve for releasing the air.

For reasons, which have been clarified above, the package will retain its pre-compressed state mainly untouched, that means except for the re-resilience, which is, at the compression degrees concerned, so small that it may be disregarded, and this state is thereafter stabilized during a final evacuation and closing of the package in the evacuation chamber.

As a consequence of the pre-compression, thus, the product to be packed has already before the evacuation decreased its volume to a value equal to or less to the one, which said product would have got, if it had without pre-compression been evacuated and thereafter executed to the pressure of the outer atmosphere. Consequently, no change of size of the packed product will take place, when this product, which has been pre-compressed, is exposed to the pressure of the outer atmosphere. The liner is not getting free from the inner side of the outer package, and all of the package may be made so small, that only the product in its pre-compressed state will get place in the package. The product will be situated steady within said package, and it will not be subjected to any shakings, whereby the risk for leakage will be essentially decreased. If, in spite of this, leakage should occur, the limited volume of the package will prevent that any greater quantities of air may enter into the package, and even if the tenability of the product should not be as good as with an untouched package, this product is nevertheless not destroyed even approximately so quick as in a package of the earlier known kind, having got a leakage deficiency.

By the present invention one has thus gained three essential advantages, which could be said to be the following ones:

Firstly the package will get cheaper in manufacturing costs.

Secondly the package will be pileable and smaller and thereby also more easy to transport and to store.

Thirdly, the risk for damage of the package will also be smaller and if such damage should nevertheless exist, the tenability of the product packed will not be essentially decreased.

What is claimed is:

1. An arrangement for compressing a product to be packed in a package before evacuation and closing of said package which comprises a piston, means for lowering the piston into the package to act on substantially the entire-free upper surface of the product in said package so as to compress the product in the interior of the package unidirectionally to such an extent that the product to be packed will assume at least approximately the volume which the product would assume in said package if no mechanical compression had existed but the only compression had been the one subjected to the package after closing in an evacuation chamber and thereafter being brought out into the ambient atmosphere, said means for lowering the piston including guide means for the piston movable in such a way that the piston will be directed during its downward movement into the mouth of the package, a frame for carrying up said guide means, said frame being provided to lower the guide means into the mouth of the package before the piston has been lowered, means for subjecting said package after said compression to evacuation to further reduce the internal pressure of the product to be packed and means for sealing and closing said package.

2. An arrangement according to claim 1, in which a casing is provided rightly to contact the sides of the package which will show a tendency during the compression activity of the piston to be changed as to their shape or to burst.

3. An arrangement according to claim 2 in which the casing is formed by a well having bottom and walls, shaped according to the package.

4. An arrangement according to claim 2 in which the casing is formed by a bottom supporting part with holders for the side edges.

5. An arrangement according to claim 1, in which the guide means is elastically resilient and is formed by a skirt of rubber.

6. An arrangement according to claim 1 including one or more back movement valves which are closed during the pre-compression movement of the piston but opened for releasing air at the return movement of the piston.

7. An arrangement according to claim 1 including two pistons having mutually different dimensions are provided to cause the pre-compression in consequence after each other, so that preparatory pre-compression is caused by the piston having smaller area, and the final pre-compression is caused by the piston having a greater area.

* * * * *